United States Patent [19]

Saitou et al.

[11] Patent Number: 4,797,354

[45] Date of Patent: Jan. 10, 1989

[54] SILVER HALIDE EMULSIONS COMPRISING HEXAGONAL MONODISPERSE TABULAR SILVER HALIDE GRAINS

[75] Inventors: Mitsuo Saitou; Shigeharu Urabe; Katsuhisa Ozeki, all of Kanagawa, Japan

[73] Assignee: Fuji Photo Film Co., Ltd., Kanagawa, Japan

[21] Appl. No.: 23,040

[22] Filed: Mar. 6, 1987

[30] Foreign Application Priority Data

Mar. 6, 1986 [JP] Japan ..... 61-48950
Dec. 16, 1986 [JP] Japan ..... 61-299155

[51] Int. Cl.[4] ..... G03C 1/02
[52] U.S. Cl. ..... 430/567; 430/569
[58] Field of Search ..... 430/567, 569

[56] References Cited

U.S. PATENT DOCUMENTS 4,067,739 1/1978 Lewis ..... 430/567
4,150,994 4/1979 Maternaghan ..... 430/567
4,184,877 1/1980 Maternaghan ..... 430/569
4,184,878 1/1980 Maternaghan ..... 430/567
4,301,241 11/1981 Saito ..... 430/567
4,433,048 2/1984 Solberg et al. ..... 430/567
4,434,226 2/1984 Wilgus et al. ..... 430/567
4,439,520 3/1984 Kofron et al. ..... 430/496

*Primary Examiner*—Mukund J. Shah
*Attorney, Agent, or Firm*—Sughrue, Mion, Zinn, Macpeak & Seas

[57] ABSTRACT

A silver halide emulsion is described comprising a dispersion medium and silver halide grains, wherein the projected area of hexagonal tabular silver halide grains having as the outer surfaces two parallel hexagonal planes having a ratio of the longest edge length to the shortest edge length (referred to as the adjacent edge ratio) of 2/1 or less accounts for at least 70% of the projected area of the whole silver halide grains, and further the hexagonal tabular silver halide grains are monodisperse grains. The process of production of the silver halide emulsions is also described.

8 Claims, 9 Drawing Sheets

SILVER HALIDE EMULSIONS COMPRISING HEXAGONAL MONODISPERSE TABULAR SILVER HALIDE GRAINS

FIELD OF THE INVENTION

The present invention relates to a silver halide emulsions useful in the field of photography, and more particularly to a silver halide emulsion comprising a dispersion medium and tabular silver halide grains. The present invention further relates to a process for producing the silver halide emulsion.

BACKGROUND OF THE INVENTION

Tabular silver halide grains having a parallel twin plane (which hereinafter are referred to as tabular grains) have the following photographic properties:

(1) The ratio of the surface area to the volume (hereinafter, the ratio is referred to as specific surface area) of the tabular grains is large and a large amount of sensitizing dye(s) can be adsorbed onto the surface, whereby the spectral sensitivity is relatively higher than the inherent sensitivity thereof.

(2) When a silver halide emulsion containing the tabular grains is coated and dried, the grains are disposed in parallel to the surface of the support, whereby the thickness of the coated emulsion layer can be thinned to improve the sharpness of images.

(3) In an X-ray photographic system, by adding sensitizing dye(s) to tabular grain silver halide emulsions, the amount of crossover light can be remarkably reduced, since the extinction coefficient of the dye(s) is larger than the extinction coefficient by the indirect transition of the silver halide (AgX), whereby the degradation of image qualities can be prevented.

(4) The silver halide emulsion containing the tabular grains causes less scattering of light and hence can give images having high resolution.

(5) The silver halide emulsion containing the tabular grains has a low sensitivity for blue light and hence when the emulsion is used for a green-sensitive emulsion layer or a red-sensitive emulsion layer of a color photographic film, a yellow filter layer can be omitted from the color photographic film.

Owing to these various advantages, the tabular grain silver halide emulsions have hitherto been used for high speed photographic materials on market.

Tabular grains, of silver halide emulsions, having an aspect ratio of at least 8 (i.e., at least 8/1) are disclosed in Japanese Patent Application (OPI) Nos. 113926/83, 113927/83, 113928/83 (the term "OPI" as used herein refers to a "published unexamined Japanese patent application"), etc.

The term "aspect ratio" is the ratio of the diameter of the tabular grain to the thickness thereof, and is expressed herein as ratio of two number (if omitted, the second number is considered as being 1). Furthermore, the "diameter" of the grain is defined as the diameter of a circle having an area equal to the projected area of the grain as viewed in a micrograph or an electron micrograph of an emulsion. Also, the thickness of the grain is shown by the distance between two parallel planes constituting the tabular grain.

Also, U.S. Pat. No. 4,439,520 describes a color photographic material having improved sharpness, sensitivity and graininess thereof by using tabular grains having a thickness of less than 0.3 μm and a diameter of at least 0.6 μm for at least one of the green-sensitive emulsion layer and the red-sensitive emulsion layer.

However, as shown in the examples of the aforesaid patent, the tabular grains prepared by the conventional process show poor monodispersibility and hence have disadvantages such as that:

(1) the increase of contrast (i.e., high gamma) of the characteristic curve cannot be expected, and (2) when the emulsion containing the large silver halide grains and the small silver halide grains is chemically sensitized, it is difficult to apply the optimum chemical sensitization to both of the silver halide grains, because the optimum condition for the chemical sensitization differs between the large grains and the small grains.

Accordingly, various attempts for improving the monodispersibility of tabular grains have hitherto been proposed.

In the monodisperse tabular grains disclosed in Japanese patent application (OPI) No. 153428/77 and U.S. Pat. Nos. 4,150,994, 4,184,877 and 4,184,878, there is a restriction of using AgI crystals as the nuclei and the content of the hexagonal tabular silver halide grains in the present invention (which grains are thought to be a tabular grain having two parallel twin planes in one grain, and hereinafter are referred to as hexagonal tabular grains) in the grains obtained is less.

Japanese patent application (OPI) No. 142329/80 and U.S. Pat. No. 4,301,241 disclose the growing condition for monodisperse tabular grains, but since the nucleus forming condition for seed crystals used in the example was improper, the tabular grains formed contained less hexagonal tabular grains than in the case of the present invention.

Japanese patent application (OPI) No. 112142/86 discloses monodisperse twin grains, but since spherical grains are used as the seed crystals, the aspect ratio of the silver halide grains obtained in the examples thereof is up to 2.2, which is a low aspect ratio.

Japanese patent application (OPI) No. 39027/76 also discloses a similar grain forming process to the preceding Japanese patent application (OPI) but since the disclosed invention does not intend to increase the ratio of the hexagonal tabular grains of the present invention, the ratio of the hexagonal tabular grains in the disclosed grains is low.

Also, monodisperse twin grains are described in the examples of French Pat. No. 253,406, but the ratio of the projected area of triangular tabular grains measured on the micrographs of the grains described therein is at least 50%, and hence the tabular grains disclosed in the patent are different from the tabular grains of the present invention.

The silver halide emulsion containing both tabular grains having 3 or 5 parallel twin planes (triangular form) and the tabular grains having 2 parallel twin planes (hexagonal form) as described in the aforesaid patent has a demerit that the chemical sensitization thereof is not performed uniformly since the chemical sensitization characteristics of the former grains differs from that of the latter grains. Also, since the tabular grains in the aforesaid patent are formed by the application of physical ripening only after the formation of the nuclei, the tabular grains have the disadvantages that a dopant such as a metal ion, etc., cannot be introduced into a desired position in the grains under control, and also it is difficult to form large monodisperse grains.

Furthermore, when triangular tabular grains and hexagonal tabular grains each having the same projected area are compared with each other, the largest grain size portion of the former is 1.23 times the largest grain size portion of the latter and hence the graininess is improved by the existence of such a larger proportion of the hexagonal tabular grains.

Also, tabular grains are disposed in the emulsion layer in such a manner that the two parallel outer planes become parallel to the coated surface but they are randomly piled on each other in the perpendicular direction with respect to the coated surface and hence they have the disadvantages that the graininess is deteriorated and the covering power is reduced. These disadvantages are severe in the case of triangular tabular grains.

SUMMARY OF THE INVENTION

An object of the present invention is to provide a negative-working silver halide emulsion and a direct reversal silver halide emulsion containing silver halide grains having a uniform shape and good monodispersibility, and showing improved sensitivity, gradation, graininess, sharpness, resolution, covering power, image quality, and pressure stability.

Another object of the present invention is to provide a process for producing the above-described silver halide emulsion.

It has now been discovered that the above-described objects of the present invention can be attained by the present invention as set forth below.

That is, according to the present invention, a silver halide emulsion is provided comprising a dispersion medium and silver halide grains, wherein the projected area of hexagonal tabular silver halide grains having as the outer surfaces two parallel hexagonal planes having a ratio of the longest edge length to the shortest edge length (which hereinafter is referred to as the adjacent edge ratio) of 2/1 or less accounts for at least 70% of the projected area of the whole silver halide grains, and further the hexagonal tabular silver halide grains are monodisperse grains.

According to another embodiment of the present invention, there is further provided a process for producing a silver halide emulsion comprising a nucleus formation step, a ripening step, and a grain growing step, which comprises performing the nucleus formation step in a reaction aqueous solution at a temperature of from 5° C. to 48° C. and pBr of from 1.0 to 2.5.

DETAILED DESCRIPTION OF THE INVENTION

Figure 1:
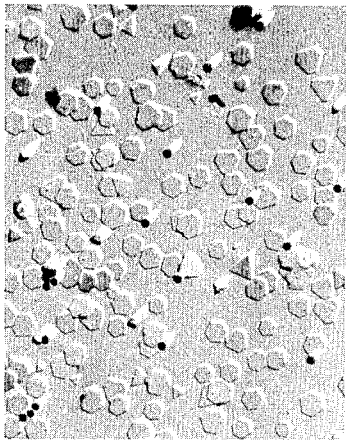
FIGS. 1 to 6 are electron micrographs of the silver halide crystal grains in the silver halide emulsions obtained in Examples 1 to 6, respectively, at a magnification of 2,850×, with the black spheres (circles) therein being latex particles for measuring the grain size.

The monodispersibility in the present invention is shown by the coefficient of variation, i.e., the value obtained by dividing a dispersion (standard deviation) of grain sizes shown by the diameters of the circles having areas equal to the projected areas by the mean grain size thereof.

The grain size distribution of a silver halide emulsion composed of light-sensitive silver halide grains having a uniform grain shape and a small dispersion of grain sizes show a nearly normal distribution and the standard deviation thereof can be easily obtained. The grain distribution of the monodisperse silver halide grains in the present invention has a coefficient of variation of the sizes of at most 20%, preferably at most 15%.

The hexagonal tabular grains in the present invention are the silver halide grains having parallel twin planes, the (111) crystal plane having a hexagonal shape and the aspect ratio thereof being at least 2.5, preferably from 2.5 to 20, and more preferably from 4 to 16. The grain sizes of the hexagonal tabular grains are at least 0.2 μm, and preferably from 0.2 μm to 3 μm.

Also, it is preferred that the hexagonal tabular grains for use in the present invention have grain sizes of from 0.2 to 2.2 μm and an aspect ratio of from 2.5 to 12, from the viewpoint of preventing the grains becoming liable to be bent when a pressure or a physical impact is applied to the tabular grains during stirring for the preparation of emulsion or in the dry state of the emulsion layer and also the viewpoint of preventing latent images in the grains being dispersed in the aforesaid case.

Furthermore, non-twin silver halide grains having grain sizes of from 0.25 μm to 0.75 μm such as a cube have, in general, a particularly large light scattering effect factor (Qsca), which causes problems for photographic materials. However, in the case of the hexagonal tabular grains in the present invention, it is preferred that the grain sizes are from 0.25 μm to 0.75 μm and the aspect ratio is from 3 to 20 from the viewpoint of reducing Qsca.

It is preferred that the average aspect ratio of the silver halide emulsion of the present invention is at least 2.5, preferably from 2.5 to 20, and more preferably from 4 to 16. The average aspect ratio is the average value of the aspect ratios of the hexagonal tabular grains having an aspect ratio of at least 2.5 in the present invention.

The hexagonal tabular grains in the present invention also have the characteristic that the adjacent edge ratio thereof is 2/1 or less. The adjacent edge ratio is the ratio of the longest edge length to the shortest edge length forming the hexagonal shape.

If the adjacent edge ratio of the hexagonal tabular grains in the present invention is 2/1 or less, the corners thereof may have roundness to some extent.

When the corner has roundness to some extent, the length of the edge is shown by the distance between the cross point of the extended straight line portion of the edge and the extended straight line portion of one adjacent edge and the cross point of the extended straight line portion of the aforesaid edge and the extended straight line portion of another adjacent edge.

It is preferred that at least ½, and preferably at least 4/5 of each edge forming the hexagonal shape of the hexagonal tabular grains in the present invention substantially forms a straight line.

In the present invention, it is more preferred that the adjacent edge ratio is from 1.0/1 to 1.5/1.

The silver halide emulsion of the present invention comprises a dispersion medium and silver halide grains, wherein the projected area of hexagonal tabular silver halide grains having two parallel hexagonal twin planes having the adjacent edge ratio of 2/1 or less accounts for at least 70%, preferably at least 80%, more preferably at least 90%, of the projected area of the whole silver halide grains.

The hexagonal tabular grains in the present invention have the characteristic of having two parallel twin planes, which can be confirmed by viewing a thin cut piece of the section of a photographic film coated with the emulsion by a transmission type electron microscope at low temperature (e.g., the temperature of liquid nitrogen).

The composition of the hexagonal tabular silver halide gains in the present invention may be silver bromide, silver iodobromide, silver chlorobromide, or silver chloroiodobromide, but is preferably silver bromide or silver iodobromide. When the silver iodobromide contains silver iodide, the content thereof is up to about 30 mol%, and preferably up to 10 mol%.

The crystal structure may be uniform in halogen composition throughout the grain, may differ in halogen composition between the inside and the outside thereof, or may have a layer structure. Also, it is preferred that the silver halide grains contain reduction sensitizing silver nuclei. Whether or not silver halide grains contain the reduction sensitizing silver nuclei can be easily determined by the observation of the reversal images of existing internal fog in the case of imagewise exposing the photographic material containing the silver halide grains, internally developing the photographic material by ordinary process, and forming the H-D curve.

Also, the hexagonal tabular grains in the present invention are not required to contain AgI nuclei in the grains since it is unnecessary to use AgI nuclei as the seed crystal as the case of Japanese Patent Application (OPI) No. 153428/77.

The production process for the silver halide emulsion of the present invention is further explained below.

That is, the silver halide emulsion containing the hexagonal tabular grains is produced by performing, after the formation of the nuclei for silver halide grains, Ostwald ripening (which hereinafter is referred to as ripening) and grain growing.

(1) Nucleus Formation:

The nucleus formation is performed by adding an aqueous solution of a water-soluble silver salt and an aqueous solution of an alkali halide to an aqueous solution containing a dispersion medium while keeping the liquid temperature at 5° C. to 48° C., preferably 15° C. to 39° C. and pBr at 1.0 to 2.5. The dispersion medium may be present in at least one of the aqueous solution of the soluble silver salt and the aqueous solution of the alkali halide instead of or together with the aqueous solution containing the dispersion medium.

In the present invention, the temperature at the formation of nuclei is from 5° C. to 48° C., preferably 15° C. to 39° C., as described above, since the probability of the nucleus formation of tabular grains is very high within such temperature range as compared to the nucleus formation of tabular grains at 40° C. to 80° C. as described in Japanese patent application (OPI) Nos. 113926/83, 113927/83 and 113928/83.

In the conventional nucleus formation which is performed at 40° C. to 80° C., the concentration of $Br^-$ is increased in order to increase the proportion of tabular grains nucleated at the nucleus formation but when the concentration of $Br^-$ is increased, the proportion of non-parallel multiple twin grains is increased, although the proportion of grains not containing twin plane is reduced, whereby it is difficult to increase the proportion of tabular grains in the silver halide emulsion which is obtained in such a case. Also, if it is forcibly intended to increase the proportion of tabular grains in the aforesaid case, the grains containing a high proportion of large tabular grains are obtained and grains having a high proportion of fine tabular grains are not obtained.

On the other hand, when the process of the present invention is used, silver halide grains having a high proportion of fine tabular grains and a good dispersibility are obtained. As the temperature is decreased, the proportion of tabular grains become higher but since the aqueous gelatin solution is gelled if the temperature is too low, the temperature range of from 5° C. to 48° C. is effective, and the temperature range of from 15° C. to 39° C. is more effective.

Also, a second reason for employing the lower temperature is that the nuclei of tabular grains formed can stably exist without Ostwald ripening at the nucleus formation. Also, since the growing rate of nuclei is very slow at the low temperature, whereby the formation of nuclei having large size as the conventional process can be restricted and the distribution of the sizes of nucleus grains (nucleus grains formed at the nucleus formation) can be narrowed. In this case, fine nucleus grains having an average grain size of up to 0.2 μm, and particularly up to 0.10 μm, can be obtained.

A third reason for employing low temperature is that the yield for the tabular grain silver halide emulsion obtained in the case of using the same reaction vessel is high. In the nucleus formation at a high temperature, tabular grains formed at the beginning of the nucleus formation grow fast and grow largely in the latter period of the nucleus formation; hence, it is necessary to shorten the nucleus formation period. However, if large amounts of an aqueous solution of silver nitrate and an aqueous solution of an alkali halide are added in a short period of time, the proportion of multiple twin grains having non-parallel twin planes is increased, and hence large amounts of silver nitrate and alkali halide cannot be added. On the other hand, tabular grains formed at the beginning of the nucleus formation do not grow fast at a low temperature, and hence the nucleus forming period can be more prolonged. Accordingly, large amounts of silver nitrate and an alkali halide can be added without increasing the proportion of multiple twin grains having non-parallel twin planes at a low temperature, and hence the yield for the tabular grain silver halide emulsion which is obtained in the case of using the same reaction vessel can be increased.

In the present invention, pBr is kept in a range of from 1.0 to 2.5 during the nucleus formation as described above. This is because if pBr is less than 1.0, non-parallel twin grains are intermingled, the solubility of silver bromide becomes too high, and also the amount of silver nitrate which is added for reducing the concentration of $Br^-$ at the transfer to the subsequent ripening step is undesirably increased. Also, if pBr is over 2.5, the proportion of tabular grains is undesirably decreased.

The hexagonal tabular grains in the present invention have two parallel twin planes therein and also the silver halide emulsion of the present invention has the feature that the projected area of hexagonal tabular grains accounts for at least 70% of the projected area of the whole silver halide grains. This can be attained by controlling supersaturation factors during the formation of the twin planes in the nucleus formation conditions. The frequency of forming the twin planes during the nucleus formation depends upon various supersaturation factors (the temperature at the nucleus formation, the gelatin concentration, the addition rates of an aqueous silver salt solution and an aqueous alkali halide solution, the concentration of $Br^-$, the rate of stirring, the content of $I^-$ in the aqueous alkali halide solution added, the amount of a silver halide solvent, pH, the concentrations of salts (potassium nitrate, sodium nitrate, etc.), etc.) and the dependence thereof is illustrated by the accompanying FIGS. 12 to 21. Practically, based on viewing such figures, these various supersaturation factors are controlled so that the probability of forming two twin planes in parallel per grain during the nucleus formation is increased and the form of the finally formed silver halide grains is in the condition range of the silver halide emulsion of the present invention. More practically, while observing the replica images of the finally formed silver halide grains by a transmission type electron microscope, the conditions of the aforesaid supersaturation factors at the nucleus formation may be controlled.

Usually, when these supersaturation factors are increased, the silver halide grains formed change as follows, i.e., (a) octahedral regular grains → (b) grains having a single twin plane → (c) grains having two parallel twin planes (aimed product) → (d) grains having non-parallel twin planes and e) grains having 3 or more twin planes. Thus, these various supersaturation factors are controlled so that the proportion of the (c) grains in the finally obtained grains is in the range of the present invention defined in the claim thereof.

Also, it is more preferred that the total supersaturation conditions by the combination of these various supersaturation factors are kept constant during the nucleus formation period.

The silver halide grains shown in the example of French Pat. No. 253,406 has a high proportion of triangular tabular grains (tabular grains having 3 parallel twin planes) and this is considered to be caused by the employment of high supersaturation conditions during the nucleus formation.

Preferred conditions for the nucleus formation are as follows.

The dispersion medium is gelatin and gelatin is modified gelatin such as alkali-processed gelatin, acid-processed gelatin, low molecular weight gelatin (having molecular weight of from 2,000 to 100,000), phthalated gelatin, etc.

The concentration of gelatin is from 0.05 to 2.0% by weight, and preferably from 0.05 to 1.6% by weight.

In general, an aqueous gelatin solution has a gelatin concentration of from 2.0 to 10% by weight, but by the employment of the aforesaid gelatin concentration, the probability of the formation of tabular grains becomes very high as compared with the case of employing the general gelatin concentration.

When unmodified gelatin is used, a particularly effective gelatin concentration of the aqueous gelatin solution is in the range of from 0.05 to 2% by weight, specifically from 0.05 to 1.6% by weight.

The lower the gelatin concentration, the higher the probability of the formation of tabular grains, which is preferred, but if the concentration of gelatin is too low, the function of gelatin as protective colloid is reduced to cause the aggregation of grains, and hence the gelatin concentration of lower than 0.05% by weight is not preferred.

In the case of the nucleus formation at low temperature, the use of low molecular weight gelatin is more effective, since the aqueous gelatin solution does not cause gelation even at low temperature. The effective molecular weight of the low molecular weight gelatin in this case is from 2,000 to 100,000.

The content of $I^-$ which is initially present in an aqueous solution to be added is preferably up to 0.03 mol/liter. Also, the addition rate of silver nitrate is preferably from 0.5 g/min. to 30 g/min. per liter of the reaction aqueous solution.

As to the composition of an aqueous alkali halide solution added, it is preferred that the content of $I^-$ to is at most the solid solubility limit of AgBrI, particularly up to 10 mol%.

The concentration of unrelated salts in the reaction solution is preferably from 0 to 1 mol/liter. The pH of the reaction solution may be from 2 to 10, but in the case of introducing reduction sensitizing silver nuclei, the pH is preferably from 8.0 to 9.5.

Also, the concentration of a silver halide solvent in the reaction solution is preferably from 0 to $1.5\times10^{-1}$ mol/liter. Examples of the silver halide solvent which can be used in the present invention will be described further hereinafter.

(2) Ripening:

In the nucleus formation described above in (1), fine tabular grain nuclei are formed and at the same time many other fine grains (in particular, octahedral and single twin grains) are formed. It is necessary to extinguish grains other than tabular grain nuclei before entering the growing step described below, in order to provide nuclei having shapes suitable for forming tabular grains and good monodispersibility. For enabling the aforesaid procedure, it is known to perform Ostwald ripening subsequent to the nucleus formation. Since the Ostwald ripening proceeds slowly at low temperatures, from the viewpoint of actual use, it is required to perform the ripening at 40° C. to 80° C., and preferably 50° C. to 80° C. In the ripening process, the fine octahedral grains and the single twin fine grains are dissolved and deposited on the tabular nuclei, whereby the existing ratio of tabular grains is increased.

As the ripening process in the present invention, the following processes are preferred.

(1) After the formation of nuclei, the concentration of gelatin and the value of pBr are controlled, then the temperature of the system is increased, and ripening is performed until the proportion of the hexagonal tabular grains is maximized.

(2) After the formation of nuclei the concentration of gelatin and the value of pBr are controlled, the temperature of the system is increased, an aqueous silver nitrate solution only or both an aqueous silver nitrate solution and an aqueous alkali halide solution are added to the reaction solution at a rate so as not to form new nuclei to selectively grow hexagonal tabular grains, and after further stabilizing the hexagonal tabular grains to provide discrimination in stability between the hexagonal tabular grains to be grown and other grains to be extinguished, ripening is performed until the proportion of the hexagonal tabular grains is maximized.

(3) After the formation of nuclei, the concentration of gelatin and the value of pBr are controlled, the temperature of the system is increased and while adding an aqueous silver nitrate solution and an aqueous alkali halide solution to the reaction solution at a rate of from 0 to 10%, preferably from 0 to 3% of the critical growing rate, ripening is performed until the proportion of the hexagonal tabular grains is maximized.

The state wherein the proportion of hexagonal tabular grains is maximized can be practically determined by changing the ripening time and viewing the replica images of finally obtained grains by a transmission type electron microscope. If ripening is performed excessively, the proportion of the hexagonal tabular grains generally tends to decrease and the grain size distribution becomes broad.

Also, the value of pBr is controlled as follows:

(a) After the formation of nuclei, the emulsion formed is washed with water.

(b) After the formation of nuclei, a part of the emulsion formed is added to an aqueous gelatin solution as seed crystals.

(c) After the formation of nuclei, the concentration of halogen ion is reduced by the ultrafiltration method as described in Japanese Patent Publication No. 43727/84.

(d) An aqueous solution of silver nitrate is added to the emulsion at a rate without forming new nuclei.

(4) After the formation of nuclei, the concentration of gelatin is adjusted, the temperature of the system is increased, and ripening is performed while adding an aqueous silver nitrate solution. In this case, the addition of the aqueous silver nitrate solution has a function of neutralizing excess $Br^-$ used during the formation of nuclei to control the value of pBr for the subsequent growing step and a function of efficiently performing the ripening step. In this case, the addition rate of silver nitrate is generally from 0.05 g/min. to 5 g/min., and preferably from 0.1 g/min. to 2 g/min. in the case of forming the nuclei with 1 g of silver nitrate.

The growing under low supersaturation in the steps (3) and (4) simultaneously causes so-called Ostwald ripening and slow growing of grains, which can effectively perform the ripening step.

Preferred conditions at ripening in the aforesaid steps (1) to (4) are as follows.

The ripening temperature is from 40° C. to 80° C., preferably from 50° C. to 80° C. The concentration of gelatin is from 0.05 to 10% by weight, preferably from 1.0 to 5.0% by weight. The concentration of a silver halide solvent is from 0 to 0.4 mol/liter, preferably from 0 to 0.1 mol/liter. Examples of the silver halide solvent for use in this case are described hereafter. Also, the value of pBr is generally from 1.2 to 2.5, and preferably from 1.3 to 2.2.

In addition, in the step (4) described above, the pBr value changes from the pBr value (of 1.0 to 2.5) just after the formation of nuclei and increases with the addition of silver nitrate.

(3) Growing:

In the crystal grain growing subsequent to the ripening step, it is preferred that for a period of at least the first ⅓ of the grain growing period, the pBr value is kept at 1.8 to 3.5, and for a period of at least the first ⅓ of the remainder of the grain growing period, the pBr value is kept at from 1.5 to 3.5. Also, it is preferred that the addition rates of silver ion and halogen ion in the crystal growing period are from 20 to 100%, and particularly preferably from 30 to 100%, of the critical crystal growing rate. In this case, the addition rates of silver ion and halogen ion are increased with the growth of silver halide crystals and as a manner of increasing the addition rates, the addition rate (flow rates) of an aqueous silver salt solution and an aqueous halide solution each having a constant concentration may be increased or the concentrations of an aqueous silver salt solution and an aqueous halide solution may be increased as described in Japanese Patent Publication Nos. 36890/73 and 16364/77. Also, a very fine grain silver halide emulsion having grain sizes of up to 0.10 μm is previously prepared and the very fine grain emulsion may be added thereto with an increased addition rate. Furthermore, a combination of the aforesaid methods may be employed. The addition rates of silver ion and halogen ion may be increased in stepwise or continuously.

In this case, the manner of increasing the addition rates of silver ion and halogen ion is determined by the relation between the concentration of the existing colloid, the solubility of silver halide crystal grains, the stirring extent in the reaction vessel, the grain sizes and concentration of crystals existing each time, the hydrogen ion concentration (pH) in the aqueous solution in the reaction vessel, the silver ion concentration (pAg) thereof, etc., and the final grain sizes and the grain size distribution of the aimed silver halide grains. However, the aforesaid manner can be simply determined by conventional experiment.

That is, the upper limit of the addition rates of silver ion and halogen ion may be set slightly less than the addition rates for forming new crystal nuclei, and the upper limit values may be determined by practically forming silver halide crystals about various addition rates of silver ion and halogen ion in actual system, sampling the crystals from the reaction vessel, and confirming the existence of the formation of new crystal nuclei by microscopic observation.

The aforesaid procedure is described in detail in Japanese patent application (OPI) No. 142329/80.

It is preferred that the iodide content of the silver halide deposited on the nuclei at the crystal growing step is from 0 mol% to the solid solubility limit concentration.

As for the pH of the solution while growing crystals, the silver halide solvent used, the stirring method, and the kind of binders, the descriptions of Japanese patent application (OPI) No. 142329/80 can be referred to, and some of them are described hereafter.

The tabular silver halide grains in the present invention thus formed can be used for a silver halide emulsion as is, but negative working silver halide emulsions (having grain sizes of 0.3 to 4 μm) having various aspect ratios and a controlled halogen composition in the shell portion can be prepared using the tabular grains as the seed crystals, as described below.

Also, the silver halide emulsion obtained in the present invention as described above can be used for preparing a core/shell type direct reversal silver halide emulsion using the silver halide grains as the core. The shell portion of the core/shell type emulsion can be formed by the same condition as the case of the crystal growth in the present invention described above but the descriptions of U.S. Pat. Nos. 3,761,276, 4,269,927 and 3,367,778 can be referred to.

Examples of the silver halide for use in the present invention are silver bromide, silver iodobromide, and silver chlorobromide and silver chloroiodobromide, each containing up to 30 mol % silver chloride.

The silver halide emulsion prepared by the process of the present invention is preferably composed of mainly silver iodobromide grains, and in this case, the distribution of silver iodide in the grains may be uniform throughout the grain, high in inside concentration, or high in surface concentration.

Generally, internal latent image forming type silver halide grains are superior to surface latent image forming type silver halide grains in the following points.

(1) Silver halide crystal grains have a spatial charge layer formed therein and electrons generated by light absorption are directed to the inside of the grains while positive holes generated are directed to the surface thereof. Accordingly, if the latent image sites (electron trap sites), i.e., sensitivity specks, are formed in the inside of the grains, the occurrence of the recombination of electron and positive hole can be prevented, latent images can be formed at high efficiency, and a high quantum sensitivity can be realized.

(2) Since the sensitivity specks exist in the inside of the silver halide grains, they are not influenced by moisture and oxygen and hence the silver halide grains of this type are excellent in storability.

(3) Since latent images formed by light exposure exist inside of the grains, they are not influenced by moisture and oxygen and hence the latent image stability is very high.

(4) When the silver halide emulsion is spectrally sensitized by adsorbing sensitizing dye(s) on the surfaces of the silver halide grains thereof, the light absorption sites (sensitizing dyes in the surface portion) are separated from the latent image sites (sensitivity specks in the inside thereof), whereby the recombination of dye positive holes and electrons can be prevented to prevent the occurrence of so-called intrinsic desensitization in spectral sensitization, and a high spectral sensitivity can be realized.

The internal latent image forming type silver halide grains have excellent points as described above as compared to surface latent image type silver halide grains but, on the other hand, it is difficult to form sensitivity specks inside of the grains. For forming sensitivity specks inside of the silver halide grains, after first forming silver halide grains as cores, a chemical sensitization is applied thereto to form sensitivity specks on the surfaces thereof. Thereafter, silver halide is further deposited on the cores to form so-called shells thereon. In this case, however, if the shell formation is non-uniform among the grains or in the grains, the formation of the sensitivity specks inside thereof becomes non-uniform, whereby the aforesaid superiority of the internal latent image type silver halide grains is not obtained. Such a problem does not occur in the case of using silver halide grains having high uniformity as monodisperse regular crystal grains as the core, but it becomes severe in the case of using conventional twin crystal grains or tabular grains having high non-uniformity as the cores. This problem can, however, be solved by the monodisperse tabular grain silver halide emulsion of the present invention having high uniformity.

Furthermore, for the silver halide grains in the present invention, chemical sensitization can be uniformly and most suitably applied to each grain and the internal latent image type emulsion of the present invention comprising the aforesaid silver halide grains have excellent sensitivity, graininess, and sharpness as compared to internal latent image type emulsion comprising regular crystal grains.

In the case of the core/shell type silver halide emulsion of the present invention, the mol ratio of the silver halide in the core and shell (core/shell) may be optionally selected, but is preferably from 1/20 to ½, more preferably from 1/10 to ⅓.

Also, in place of the internal chemical sensitizing nuclei or together with the nuclei, a metal ion can be doped inside of the silver halide grains in the present invention. The doping position may be the core, the interface of the core/shell, or the shell. The hexagonal tabular silver halide grains of the present invention have high uniformity and hence the position of the metal doping can be clearly indicated.

As a metal dopant, a cadmium salt, a lead salt, a thallium salt, an erbium salt, a bismuth salt, an iridium salt, a rhodium salt, the complex salt thereof, etc., are used. The metal ion for doping is usually used in a proportion of at least $10^{-6}$ mol per mol of silver halide.

The metal dopant is used in order to increase sensitivity of internal portion of the core/shell grain.

For the internal latent image forming type tabular grain silver halide emulsion of the present invention, silver bromide, silver iodobromide, or silver chlorobromide or silver chloroiodobromide each containing up to 30 mol% silver chloride is used, but silver bromide or silver iodobromide having a silver iodide content of up to 10 mol% is preferably used.

Furthermore, using the tabular grains of the present invention as host grains, guest grains having various halogen compositions may be epitaxially grown thereonto. For the epitaxial growth of such guest grains, the descriptions of Japanese Patent Application (OPI) Nos. 108526/83 and 133540/82 can be referred to.

In the nucleus formation step in the present invention, a silver halide solvent may be used for controlling the supersaturation condition for determining the twin plane forming frequency.

Further, in the ripening step in the present invention, a silver halide solvent may be used for accelerating the ripening. Also, during the crystal growing step after ripening, a silver halide solvent may be used for accelerating the crystal growth.

Silver halide solvents which are frequently used include thiocyanates, ammonia, thioethers, thioureas, etc.

Specific examples of the silver halide solvent are the thiocyanates described in U.S. Pat. Nos. 2,222,264, 2,448,534, 3,320,069, etc., ammonia, the thioether compounds described in U.S. Pat. Nos. 3,271,157, 3,574,628, 3,704,130, 4,297,439, 4,276,347, etc., the thione compounds described in Japanese patent application (OPI) Nos. 144319/78, 82408/78, 77737/80, etc., the amine compounds described in Japanese patent application (OPI) No. 100717/79, etc., etc.

During the formation or physical ripening of silver halide grains, a cadmium salt, a zinc salt, a lead salt, a thallium salt, an iridium salt or the complex salt thereof, a rhodium salt or the complex salt thereof, an iron salt or the complex salt thereof, etc., may exist in the system.

As the dispersion medium (binder or protective colloid) for the photographic silver halide emulsions of the present invention, the above-described gelatin is advantageously used, but other hydrophilic colloids can also be used.

Specific examples of the dispersion medium for use in the present invention are described in *Research Disclosure, Vol.* 176, RD No. 17643 (December, 1978), Paragraph IX.

The silver halide emulsions of the present invention can further contain various compounds known as antifoggants or stabilizers for preventing the formation of fog during the production, storage or photographic processing of the photographic light-sensitive materials containing the emulsion or stabilizing the photographic performance thereof.

The photographic light-sensitive materials of the present invention may further contain in the photographic silver halide emulsion layers polyalkylene oxides or the derivatives (e.g., the ethers, esters, amines, etc.) thereof, thioether compounds, thiomorpholines, quaternary ammonium salt compounds, urethane derivatives, urea derivatives, imidazole derivatives, 3-pyrazolidones, etc., for improving the sensitivity and contrast or for development acceleration.

Sensitizing dyes which are used for sensitizing the photographic silver halide emulsions of the present invention are described, for example, in *Research Disclosure,* Vol. 176, RD No. 17643, page 23, Paragraph IV (December, 1978).

Now, those sensitizing dye(s) and antifoggant(s) or stabilizer(s) may be added to the photographic emulsion in any steps during the production of the photographic emulsion or in any stage after the production thereof to just before coating. Examples of the former step are a step of forming silver halide grains, a step of physical ripening, a step of chemical ripening, etc.

The silver halide emulsion of the present invention can be formed on a support as a photographic emulsion layer or more (e.g., 2 or 3) photographic emulsion layers, if desired, together with other silver halide emulsion. Also, the silver halide emulsion of the present invention may be formed on, not only, one surface of a support, but also, both surfaces thereof. Also, the photographic emulsion layer can be formed as double or multiple layers each having a different spectral sensitivity.

The silver halide emulsion of the present invention can be applied for black-and-white silver halide photographic materials (e.g., X-ray photographic materials, lithographic light-sensitive materials, black-and-white negative films for photography, etc.) and color photographic materials (e.g., color negative films, color reversal films, color photographic papers, etc.). Furthermore, the photographic emulsion of the present invention can be used for diffusion transfer light-sensitive materials (e.g., color diffusion transfer elements and silver salt diffusion transfer elements ) and heat developable light-sensitive materials (black-and-white light-sensitive materials and color light-sensitive materials), etc.

Moreover, a washing method for the silver halide emulsion of the present invention, a chemical sensitization method for the emulsion, antifoggants, dispersion media, stabilizers, hardening agents, dimensional stability improving agents, antistatic agents, coating aids, dyes, color couplers, sticking preventing agents, methods of improving the photographic properties (e.g., the development acceleration, the increase of contrast, and the increase of sensitivity), etc., for the silver halide emulsions of the present invention are described, for example, in *Research Disclosure,* Vol. 176, RD No. 17643 (December, 1978), and Japanese patent application (OPI) Nos. 113926/83, 113927/83, 113928/83, and 90842/84.

An example of applying the silver halide emulsion of the present invention to multilayer photographic light-sensitive materials is described hereinafter.

In general, when a photographic light-sensitive material is prepared by coating polydisperse silver halide emulsion as a single emulsion layer, the photographic material shows low sensitivity since light is uniformly absorbed by high sensitive silver halide grains and low sensitive silver halide grains. Thus, when monodisperse silver halide grains are used, and the emulsion layer comprising large grains is disposed as the upper layer and the emulsion layer comprising small grains is disposed as the lower emulsion layer, a photographic light-sensitive film having a high toe sensitivity and a good graininess at the highly light-exposed part can be obtained since incident light is preferentially absorbed by the high sensitive large grains and remaining transmitted light is absorbed by the low sensitive small grains in the lower layer.

Furthermore, in general, it is considered that three layers of an emulsion layer comprising large grains, an emulsion layer comprising intermediate grains, and an emulsion layer comprising small grains are formed as a high sensitive emulsion layer, an intermediate sensitive emulsion layer, and a low sensitive emulsion layer. However, when these emulsion layers comprise silver halide grains having low aspect ratio such as silver halide grains of a regular crystal form, the thickness of the layers becomes thicker, whereby the sharpness of the photographic film is reduced.

On the other hand, when three layers of an emulsion layer comprising large grains, an emulsion layer comprising intermediate grains, and an emulsion layer comprising small grains, or four layers or more of emulsion layers each comprising grains having grain sizes falling within grain size ranges separated depending upon the numbers of the layers, are formed using monodisperse tabular silver halide grains of the present invention, each emulsion layer can be thinned since the silver halide grains are tabular grains having high aspect ratios, and hence a photographic light-sensitive material having a high sensitivity and high image quality is obtained without reducing the sharpness.

Accordingly, when a photographic light-sensitive material comprises two or more, preferably 3 to 5, emulsion layers comprising the monodisperse tabular grain silver halide emulsions of the present invention as photographic emulsion layer(s) having the same color sensitivity, and being arranged in such a manner that as the position of the emulsion layer is upper, the grain size thereof is larger, the effect of the monodisperse tabular grain silver halide emulsions of the present invention becomes remarkable.

The silver halide emulsion of the present invention described above has the following features:

(1) the grain sizes are monodisperse type, (2) the grain shape is hexagonal and the hexagonal silver halide grains have a uniform shape, and (3) the thickness of the grains is uniform. Also, a chemical sensitization can be most suitably applied to each grain and further the silver halide emulsion of the present invention simultaneously has the excellent properties of hexagonal tabular grains and the excellent properties of monodisperse emulsions. Thus, according to the present invention, a negative working silver halide emulsion and a direct reversal silver halide emulsion excellent in sensitivity, gradation, graininess, sharpness, resolution, covering power, image quality, storability, latent image stability, and pressure stability can be obtained The present invention will now be illustrated in more detail in and by the following examples. However, the examples are not to be construed as limiting the present invention in any manner. The unit "M" hereafter represents "mol/liter".

EXAMPLE 1

To 1 liter of a 0.8% by weight gelatin solution containing potassium bromide in a concentration of 0.05M were added a 0.39M solution of silver nitrate and a 0.39M solution of potassium bromide with stirring by a double jet method in an amount of 15 ml each over a period of 15 seconds. During the addition thereof, the gelatin solution was kept at 30° C. Thereafter, the temperature of the mixture was raised to 75° C. Then, 220 ml of a 10% by weight gelatin solution was added thereto.

After finishing the addition in the first step, 78 ml of a 0.47M solution of silver nitrate was added to the mixture over a period of 29 minutes.

Furthermore, over a period of 60 minutes after 10 minutes since the addition, 150 g of silver nitrate was added thereto at an accelerated flow rate (the flow rate at the end of the addition being 19 times the flow rate at the initiation thereof). During the 60 minutes, pBr was kept at 2.55.

Thereafter, the emulsion formed was cooled to 35° C., washed by an ordinary flocculation method and after controlling the pH and pAg at 5.5 and 8.6, respectively, at 40° C., stored under cold dark conditions at 5° C. The projected area proportion of the hexagonal tabular grains was 87% of the projected area of the whole silver halide grains thus obtained and the coefficient of variation was 16%. Furthermore, the diameter of circle corresponding to the average projected area of the tabular grains was 1.4 μm and the average thickness of the grains was 0.14 μm (see FIG. 1).

EXAMPLE 2

To 1 liter of a 0.8% by weight gelatin solution containing potassium bromide in a concentration of 0.08M were added a 2.00M solution of silver nitrate and a 2.00M solution of potassium bromide with stirring by a double jet method in an amount of 150 ml each and during the addition thereof, the gelatin solution was kept at 30° C. Thereafter, the temperature of the mixture was raised to 75° C. and then 30 g of gelatin was further added.

After finishing the aforesaid addition in the first step, 90 ml of a 1.0M solution of silver nitrate was added to the mixture. Thereafter, ripening was performed for 30 minutes.

The silver halide grains (which hereinafter are referred to as seed crystals) were washed by an ordinary flocculation method and then pH and pAg thereof were adjusted to 5.0 and 7.5, respectively, at 40° C.

In 1 liter of a 3% by weight gelatin solution was dissolved 1/10 of the seed crystals obtained above and the solution was kept at a temperature of 75° C. and pBr of 2.55. Thereafter, 150 g of silver nitrate was added to the solution at an accelerated flow rate (the flow rate at the end of the addition being 19 times the flow rate at the initiation thereof) over a period of 60 minutes. During the addition, the pBr was kept at 2.55.

Figure 2:
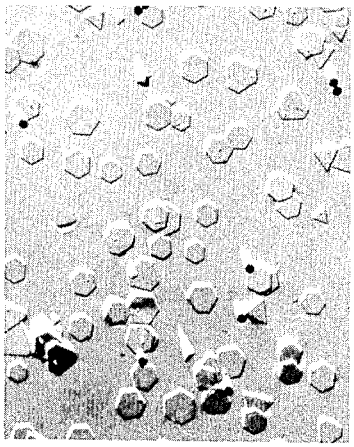

Thereafter, the silver halide emulsion obtained was cooled to 35° C., washed by an ordinary flocculation method, and after adjusting the pH and pAg to 6.5 and 8.6, respectively, at 40° C., the emulsion was stored under cold dark conditions. The projected area proportion of the hexagonal tabular grains was 80% of the projected area of the whole silver halide grains thus obtained and the coefficient of variation thereof was 18%. Furthermore, the diameter of circle corresponding to the average projected area of the tabular grains was 1.8 μm and the average thickness thereof was 0.16 μm (see FIG. 2).

EXAMPLE 3

In 1 liter of a 0.8% by weight gelatin solution containing potassium bromide in a concentration of 0.06 M were added a 2.00M solution of silver nitrate and a 2.00M solution of potassium bromide in an amount of 30 ml each with stirring by a double jet method and during the addition, the gelatin solution was kept at 30° C. After the addition of the solutions, the temperature of the mixture was raised to 75° C. and then after adding thereto 30 g of gelatin, ripening was performed at 75° C. for 20 minutes.

After finishing the aforesaid physical ripening, the pBr of the emulsion formed was adjusted to 2.55 by the ultrafiltration method described in Japanese Patent Publication No. 43727/84.

Furthermore, 150 g of silver nitrate was added to the emulsion at an accelerated flow rate (the flow rate at the end of the addition being 19 times the flow rate of the initiation thereof) over a period of 60 minutes since then and during the 60 minutes, the pBr of the emulsion was kept at 2.55.

Figure 3:
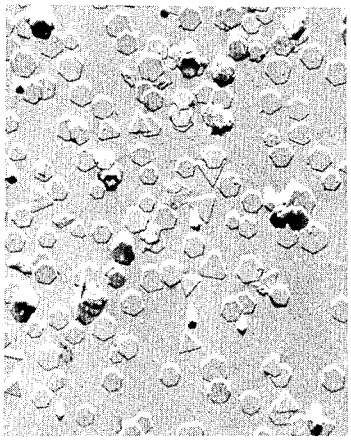

Thereafter, the silver halide emulsion thus obtained was cooled to 35° C., washed by an ordinary flocculation method, and after adjusting the pH and pAg thereof to 6.5 and 8.6, respectively, at 40° C., was stored under cold dark conditions. The projected area proportion of the hexagonal tabular grains was 87% of the projected area of the whole silver halide grains thus obtained and the coefficient of variation was 16%. Furthermore, the diameter of circle corresponding to the average projected area of the tabular grains was 1.4 μm and the average thickness thereof was 0.14 μm (see FIG. 3).

EXAMPLE 4

In 1 liter of a solution containing 3% by weight gelatin was dissolved 2/10 of the seed crystals obtained in Example 2 and the solution was kept at a temperature of 75° C. and pBr of 2.55. Thereafter, 150 g of silver nitrate was added thereto at an accelerated flow rate (the flow rate at the end of the addition being 10 times the flow rate at the initiation thereof). During the addition, a 0.1M solution of potassium iodide was added at a constant rate. Furthermore, during the addition, the pBr was kept at 2.55.

Figure 4:
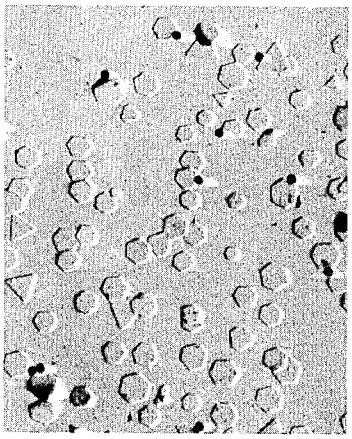

Thereafter, the emulsion thus obtained was cooled to 35° C., washed by an ordinary flocculation method, and after adjusting the pH and pAg thereof to 6.5 and 8.6, respectively, at 40° C., was stored under cold dark conditions. The projected area proportion of the hexagonal tabular grains was 84% of the projected area of the whole silver halide grains thus obtained and the coefficient of variation thereof was 19%. Furthermore, the diameter of circle corresponding to the average projected area of the tabular grains was 1.4 μm and the average thickness thereof was 0.14 μm (see FIG. 4).

EXAMPLE 5

In 1 liter of a 0.8% by weight gelatin solution containing potassium bromide in a concentration of 0.08M were added a 2.00 M solution of silver nitrate and a 2.00M solution of potassium bromide with stirring by a double jet method in an amount of 30 ml each and during the addition, the gelatin solution was kept at 30° C. Thereafter, the temperature of the mixture was raised to 75° C. and 30 g of a 10% by weight gelatin solution was added thereto.

After finishing the aforesaid first addition step, 0.3 g of 3,6-dithiooctane-1,8-diol was added to the mixture. Thereafter, 88 ml of a 1.0M solution of silver nitrate was further added to the mixture.

Furthermore, 150 g of silver nitrate was added thereto at an accelerated flow rate (the flow rate at the end of the addition being 19 times the flow rate at the initiation thereof) over a period of 60 minutes since then. During the 60 minutes, the pBr thereof was kept at 2.55.

Figure 5:
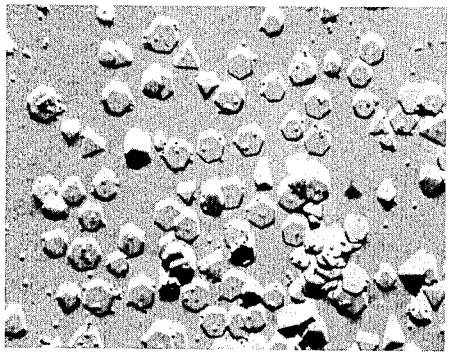

Thereafter, the emulsion obtained was cooled to 35° C., washed by an ordinary flocculation method, and after adjusting the pH and pAg thereof to 6.5 and 8.6, respectively, at 40° C, was stored under cold dark conditions. The projected area proportion of hexagonal tabular grains was 95% of the projected area of the whole silver halide grains thus obtained and the coefficient of variation thereof was 15%. Furthermore, the diameter of circle corresponding to the average projected area of the tabular grains was 1.5 μm and the average thickness thereof was 0.30 μm (see FIG. 5).

EXAMPLE 6

In 1.4 liter of a 3.0% by weight gelatin solution containing potassium bromide in a concentration of 0.08M were added a 0.5M solution of silver nitrate and 0.5 M solution of potassium bromide in an amount of 30 ml each with stirring by a double jet method. During the addition, the temperature of the gelatin solution was kept at 45° C. and after the addition, the temperature thereof was raised to 75° C.

After finishing the aforesaid first addition step, 105 ml of a 1.0M solution of silver nitrate was slowly added to the mixture and thereafter, 150 g of silver nitrate was further added thereto at an accelerated flow rate (the flow rate at the end of the addition being 19 times the flow rate at the initiation thereof) over a period of 60 minutes since then. During the 60 minutes, potassium bromide was added to keep the pBr at 2.55.

Thereafter, the emulsion obtained was cooled to 35° C., washed by an ordinary flocculation method, and after adjusting the pH and pAg thereof at 6.5 and 8.6, respectively, at 40° C., was stored under cold dark conditions.

Figure 6:
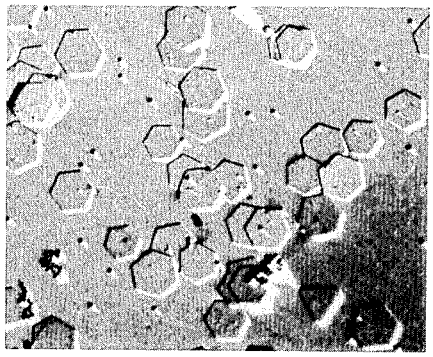

The projected area proportion of the hexagonal tabular grains was 85% of the projected area of the whole silver halide grains thus obtained and the coefficient of variation was 15%. Furthermore, the diameter of circle corresponding to the average projected area of the tabular grains was 2.5 μm and the average thickness thereof was 0.25 μm (see FIG. 6).

EXAMPLE 7

In a 4 liter reaction vessel was placed an aqueous gelatin solution (composed of 1,000 ml of water, 7 g of deionized alkali-processed gelatin, 4.5 g of potassium bromide, and 1.2 ml of a 1 N potassium hydroxide solution and having pBr of 1.42) and while keeping the temperature thereof at 30° C., 25 ml of an aqueous silver nitrate solution (containing 8.0 g of silver nitrate) and 25 ml of an aqueous solution of potassium bromide (containing 5.8 g of potassium bromide) were simultaneously added thereto over a period of 1 minute (flow rate of 25 ml/min.). Then, after stirring the mixture for 2 minutes, to 350 ml of the silver halide emulsion obtained as seed crystals was added an aqueous gelatin solution (composed of 650 ml of water, 20 g of deionized alkali-processed gelatin, 3.4 ml of 1 N potassium hydroxide solution, and 0.5 g of potassium bromide) and then the temperature of the mixture was raised to 75° C. Thereafter, ripening was performed for 30 minutes at pBr of 1.76 and then n aqueous silver nitrate solution (containing 40 g of silver nitrate in 400 ml of the solution) and an aqueous potassium bromide solution (containing 33 g of potassium bromide in 400 ml of the solution) were added thereto by a controlled double jet method at a silver potential of +10 mV for 10 minutes at a rate of 10 ml/min. After the addition, the mixture was stirred for 5 minutes and further the remaining aqueous silver nitrate solution and the remaining aqueous potassium bromide solution were added thereto by a controlled double jet method at a silver potential of +10 mV for 20 minutes at a rate of 15 ml/min. Then, after stirring the resultant mixture for 3 minutes, the emulsion thus obtained was washed with water and dispersed. The replica images of the grains of emulsion obtained were viewed by a transmission type electron microscope (magnification of 2,000×). The properties of the silver halide grains in the silver halide emulsion thus obtained were as follows.

Average Grain Size: 0.56 μm
Average Thickness: 0.093 μm
Average Aspect Ratio: 6.0

Projected Area Proportion of the Grains of the Present Invention (which hereafter means the projected area proportion of the hexagonal tabular grains to the projected area of the whole silver halide grains thus obtained): 90%

Coefficient of Variation of Grains of the Present Invention: 15.5%

Figure 7:
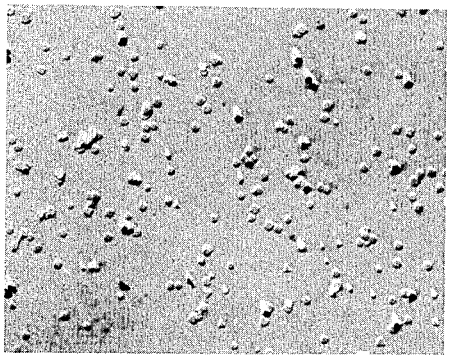
FIGS. 7, 8 and 9 are electron micrographs of the silver halide crystal grains in the silver halide emulsions obtained in Examples 7, 8 and 9, respectively, at a magnification of 2,000×.

The transmission type electron micrograph of this case is shown in FIG. 7.

EXAMPLE 8

Figure 8:
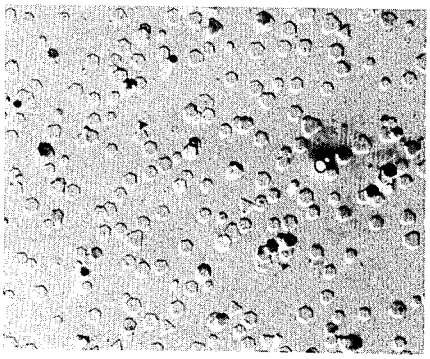

In a 4 liter reaction vessel was placed an aqueous gelatin solution (composed of 1,000 ml of water, 9 g of deionized alkali-processed gelatin, 3.9 g of sodium bromide, 1.6 ml of 1 N sodium hydroxide solution, and having pBr of 1.42) and while keeping the temperature of the solution at 30° C., 25 ml of an aqueous silver nitrate solution (containing 8.0 g of silver nitrate) and 25 ml of an aqueous sodium bromide solution (containing 5.0 g of sodium bromide) were simultaneously added to the solution over a period of 1 minute. After stirring the mixture for 2 minutes, to 350 ml of the emulsion formed as seed crystals was added an aqueous gelatin solution (containing 650 ml of water, 20 g of deionized alkali-processed gelatin, 3.4 ml of a 1 N aqueous sodium hydroxide solution, and 1.04 g of sodium bromide) and then the temperature of the resultant mixture was raised to 75° C. Then, ripening was performed for 60 minutes at pBr of 1.63, after reducing the temperature thereof to 60° C., 100 ml of an aqueous silver nitrate solution (containing 10 g of silver nitrate) was added thereto at a rate of 10 ml/min., and 1 minute and 47 seconds after the addition thereof, 82.2 ml of an aqueous sodium bromide solution (containing 5.19 g of sodium bromide) was added thereto at a rate of 10 ml/min., the additions of both solutions being finished at the same time. After 2 minutes, 300 ml of an aqueous silver nitrate solution (containing 30 g of silver nitrate) and 300 ml of an aqueous sodium bromide solution (containing 18.9 g of sodium bromide) were simultaneously added to the mixture for 20 minutes at a rate of 15 ml/min. Thereafter, the resultant mixture was stirred for 1 minute and the silver halide emulsion thus obtained was washed with water and dispersed. The replica images of the grains of emulsion thus obtained were viewed by a transmission type electron microscope (magnification of 2,000×). The electron micrograph of the grains is shown in FIG. 8.

The properties of the tabular grains of the present invention in the silver halide emulsion thus obtained are as follows.

Projected Area Proportion of the Grains of the Present Invention: 93%

Coefficient of Variation of the Grain Size of the Grains of the Present Invention: 15.3%

Average Grain Size: 1.0 μm

Average Thickness: 0.095 μm

Average Aspect Ratio: 10.5

EXAMPLE 9

To 350 ml of the seed crystals as described in Example 7 was added an aqueous gelatin solution (composed of 650 ml of water, 30 g of deionized alkali-processed gelatin, 5.1 ml of a 1 N aqueous potassium hydroxide solution, and 1.2 g of potassium bromide) and the temperature of the mixture was raised to 75° C. over a period of 10 minutes. Thereafter, ripening was performed for 50 minutes, 100 ml of an aqueous silver nitrate solution (containing 30 g of silver nitrate) was added to the mixture at a rate of 10 ml/min. and 25 seconds after the addition thereof, 95.8 ml of an aqueous potassium bromide solution (containing 20.4 g of potassium bromide) was added thereto at a rate of 10 ml/min., the additions of both solutions being finished at the same time.

Figure 9:
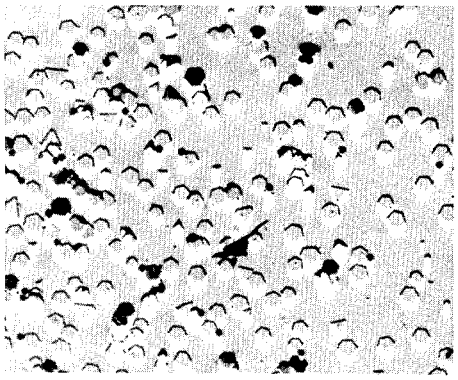

Thereafter, the resultant mixture was stirred for 2 minutes, and then 1,000 ml of an aqueous silver nitrate solution (containing 300 g of silver nitrate) and 1,000 ml of an aqueous potassium bromide solution (containing 212.3 g of potassium bromide) were simultaneously added to the aforesaid mixture at a rate of 20 ml/min. for first 20 minutes and at a rate of 30 ml/min. for the subsequent 20 minutes. Then, after stirring the mixture for 1 minute, the silver halide emulsion thus obtained was washed with water and dispersed. The replica images of the grains of emulsion thus obtained were viewed by a transmission type electron microscope and the electron micrograph is shown in FIG. 9. The properties of the grains of the present invention in the emulsion are as follows:

Average Grain Size: 1.4 μm

Average Thickness: 0.23 μm

Average Aspect Ratio: 6.1

Projected Area Proportion of the Grains of the Present Invention: 91%

Coefficient of Variation: 11.1%

EXAMPLE 10

To 350 ml of the seed crystals as described in Example 7 was added an aqueous gelatin solution (composed of 650 ml of water, 25 g of deionized alkali-processed gelatin, 5.1 ml of a 1 N potassium hydroxide solution, and 1.2 g of potassium bromide) and the temperature thereof was raised to 75° C. Then, after performing ripening for 50 minutes, 70 ml of an aqueous silver nitrate solution (containing 21 g of silver nitrate) was added thereto at a rate of 7 ml/min., and 35 seconds after the addition of the aforesaid solution, 65.9 ml of an aqueous potassium bromide solution (containing 14 g of potassium bromide) was added thereto at a rate of 7 ml/min., the additions of the solutions being finished at the same time. Thereafter, the resultant mixture was stirred for 2 minutes and the silver halide emulsion thus obtained was washed with water and dispersed. The replica images of the grains of emulsion obtained were viewed by a transmission type electron microscope.

The properties of the tabular grains of the present invention in the emulsion obtained are as follows.

Average Grain Size: 0.62 μm

Average Thickness: 0.092 μm

Average Aspect Ratio: 6.7

Projected Area Proportion of the Grains of the Present Invention: 88%

Coefficient of Variation: 15.1%

EXAMPLE 11

In a 4 liter reaction vessel was placed an aqueous gelatin solution (composed of 1,000 ml of water, 8 g of deionized alkali-processed gelatin, 4.5 g of potassium bromide, and 1.6 ml of a 1 N potassium hydroxide solution and having pBr of 1.42) and while keeping the temperature of the aqueous gelatin solution at 30° C., 100 ml of an aqueous silver nitrate solution (containing 32.6 g of silver nitrate) and 100 ml of an aqueous potassium bromide solution (containing 23.7 g of potassium bromide) were simultaneously added to the solution over a period of 4 minutes (at a flow rate of 25 ml/min.). Then, after stirring the mixture for 2 minutes, to 600 ml of the silver halide emulsion thus formed as seed crystals was added an aqueous gelatin solution (composed of 400 ml of water, 20 g of deionized alkali-processed gelatin, and 3.4 ml of a 1 N aqueous potassium hydroxide solution)and after raising the temperature of the mixture up to 75° C.,ripening was performed for 50 minutes. Then, after reducing the temperature to 60° C., 60 ml of an aqueous silver nitrate solution (containing 18 g of silver nitrate) was added thereto at a rate of 20 ml/min., and 43 seconds after the addition of the aforesaid solution, 52.9 ml of an aqueous potassium bromide solution (containing 11.1 g of potassium bromide) was added thereto at a rate of 20 ml/min., the additions of the solutions being finished at the same time. Thereafter, the mixture was stirred for 1 minute and the silver halide emulsion thus obtained was washed with water and dispersed. The replica images of the grains of emulsion obtained were viewed by a transmission type electron microscope (magnification of 2,000×).

The hexagonal tabular grains in the silver halide emulsion were tabular grains wherein about 1/3.5 of each edge was roundish. That is, the grains were tabular grains having two parallel twin planes per grain and slightly roundish corners. The properties of the tabular grains obtained are as follows.

Projected Area Proportion of the Grain of the Present Invention: 87%

Average Grain Size: 0.47 μm

Average Aspect Ratio: 6.0

Average Thickness: 0.078 μm

Coefficient of Variation: 16.5%

EXAMPLE 12

Emulsion A:

The silver halide emulsion obtained in Example 1 was most suitably chemically sensitized with $1.8\times10^{-5}$ mol/mol silver of sodium thiosulfate and $1.4\times10^{-5}$ mol/mol silver of potassium chloroaurate. The emulsion was coated at a silver coverage of 2 g/m$^2$.

Emulsion B:

To 1 liter of a 3.0% by weight gelatin solution containing potassium bromide in a concentration of 0.10 M were added a 1.00 M solution of silver nitrate and a 1.00 M solution of potassium bromide in an amount of 60 ml each over a period of 60 seconds with stirring by a double jet method. During the addition, the gelation solution was kept at 50° C. and after the addition, the temperature was raised to 75° C.

After 30 minutes since then, 150 g of silver nitrate was further added thereto at a constant flow rate over a period of 90 minutes and during the addition, the pBr thereof was kept at 1.2.

Thereafter, the silver halide emulsion thus obtained was cooled to 35° C., washed by an ordinary flocculation method, and after adjusting the pH and pAg thereof to 6.5 and 8.6, respectively, at 40° C., was stored in the cold dark conditions.

The projected area proportion of the hexagonal tabular grains was 47% of the projected area of the whole silver halide grains thus obtained and the coefficient of variation was 35%. Also, the diameter of circle corresponding to the average projected area of the tabular grains was 2.0 μm and the average thickness thereof was 0.09 μm.

The silver halide emulsion thus obtained was most suitably chemically sensitized with $1.4\times10^{5}$ mol/mol silver of sodium thiosulfate and $1.7\times10^{-5}$ mol/mol silver of potassium chloroaurate and the emulsion was coated at a silver coverage of 2 g/m$^2$.

Comparison of Photographic Property:

Each of the samples thus prepared was exposed to blue light for 1 second and then developed.

Figure 10:
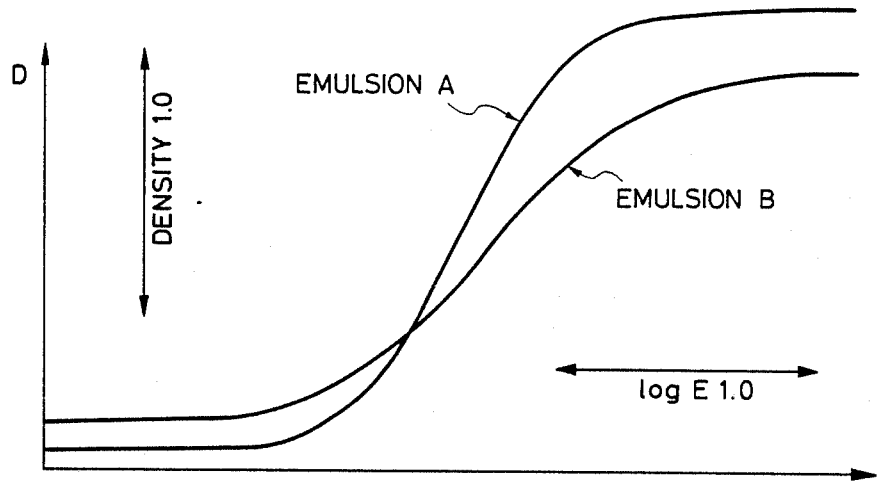
FIG. 10 is a graph showing the characteristic curves of Emulsion A and Emulsion B in Example 12, wherein the axis of abscissa shows the exposure amount (logE) and the axis of ordinate shows the density.

The development was performed using MAA-1 developer described below for 10 minutes at 20° C. and the results obtained are shown in FIG. 10.

As is clear from the results shown in FIG. 10, Emulsion B gives fog in optimum chemical sensitization level, low contrast, and the low maximum density, while Emulsion A gives low fog, high contrast, and the high maximum density.

The low fog and the high contrast in Emulsion A mean that the chemical sensitization is uniformly performed and the high maximum density means that the covering power of the hexagonal tabular grains of the present invention is large.

Figure 11:
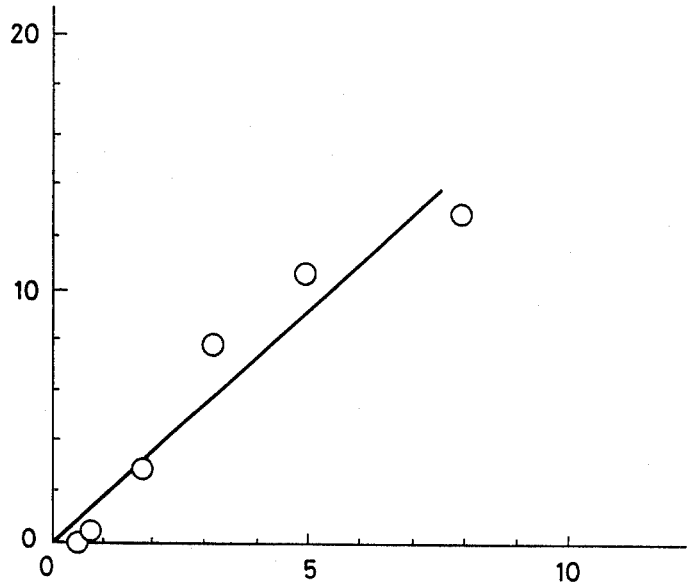
FIG. 11 is a graph showing the relation between the projected area of the silver halide grains of Emulsion B in Example 12 and the ratio (%) of silver halide grains having fogged nuclei, wherein the axis of the abscissa shows the average projected area ($\mu m^2$) of the silver halide grains and the axis of the ordinate shows the ratio (%) of the grains having the fogged nuclei.
Figure 12:
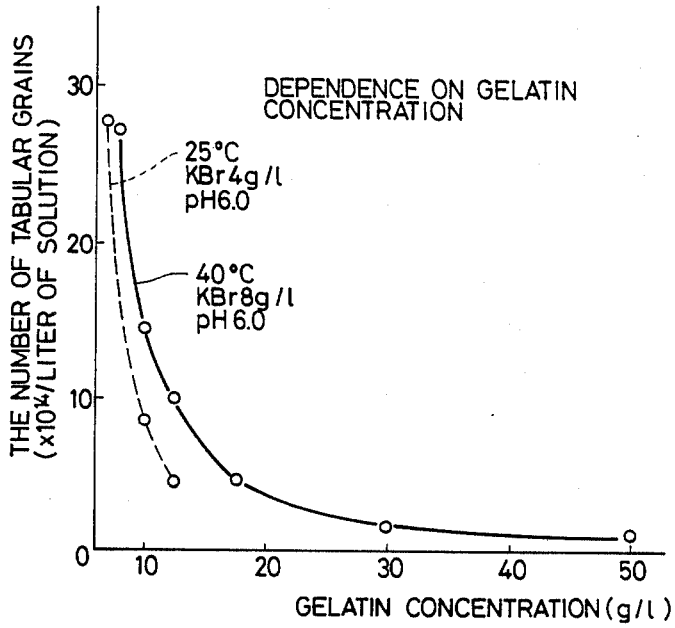
FIG. 12 is a graph showing the relation between the gelatin concentration and the number of tabular grains.
Figure 13:
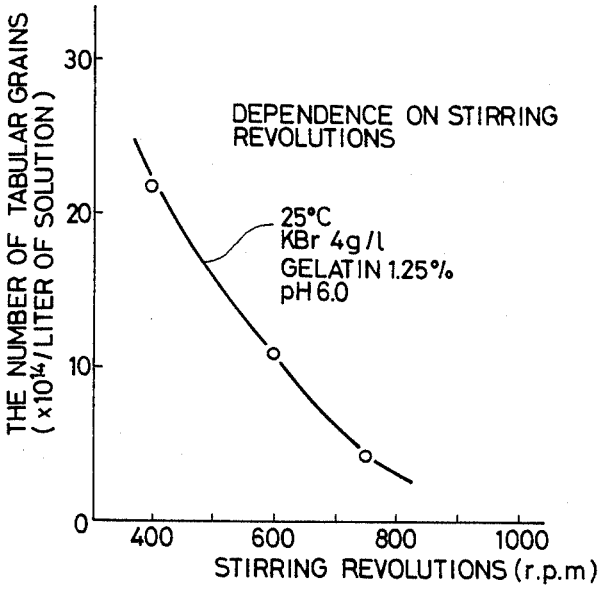
FIG. 13 is a graph showing the relation between the stirring revolutions and the number of tabular grains.
Figure 14:
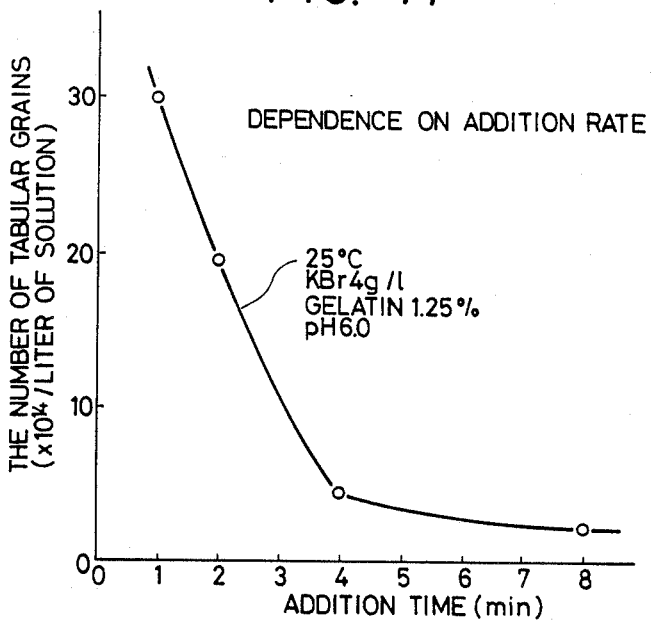
FIG. 14 is a graph showing the relation between the addition time and the number of tabular grains.
Figure 15:
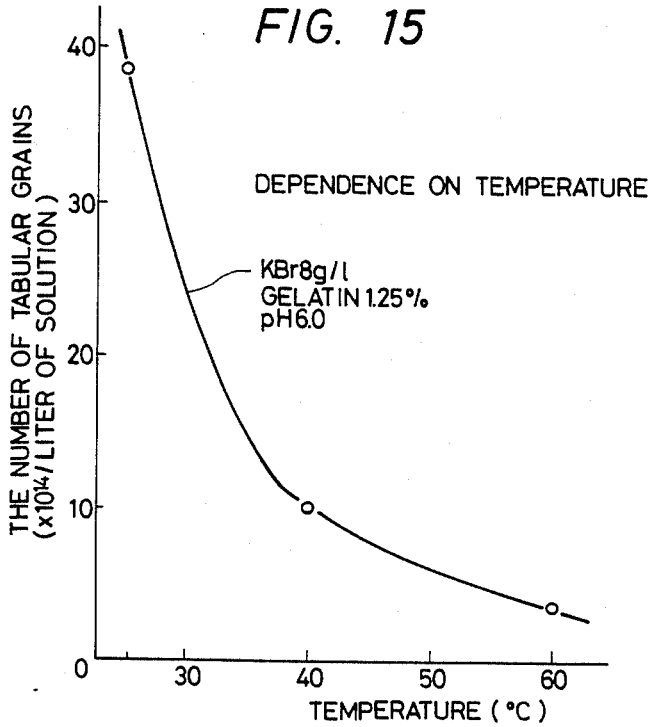
FIG. 15 is a graph showing the relation between the temperature and the number of tabular grains.
Figure 16:
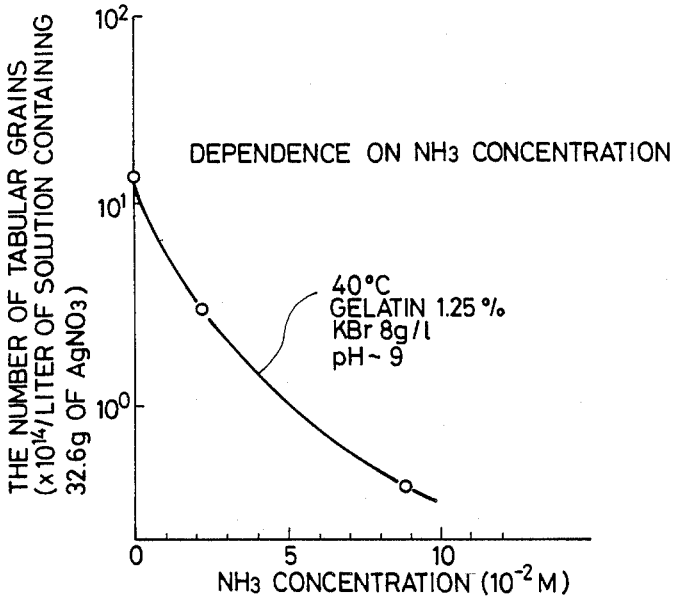
FIG. 16 is a graph showing the relation between the concentration of $NH^3$ as a silver halide solvent and the number of tabular grains.
Figure 17:
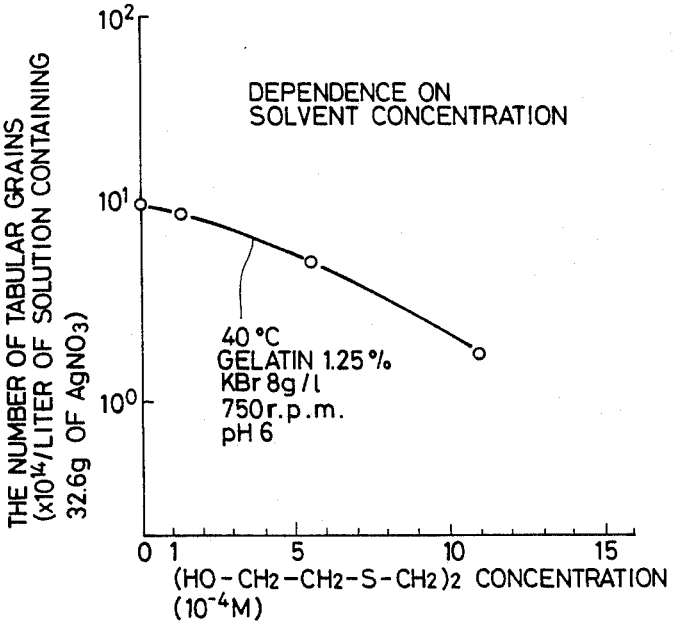
FIG. 17 is a graph showing the relation between the concentration of $(HO—CH_2—CH_2—S—CH_2)_2$ as a silver halide solvent and the number of tabular grains.
Figure 18:
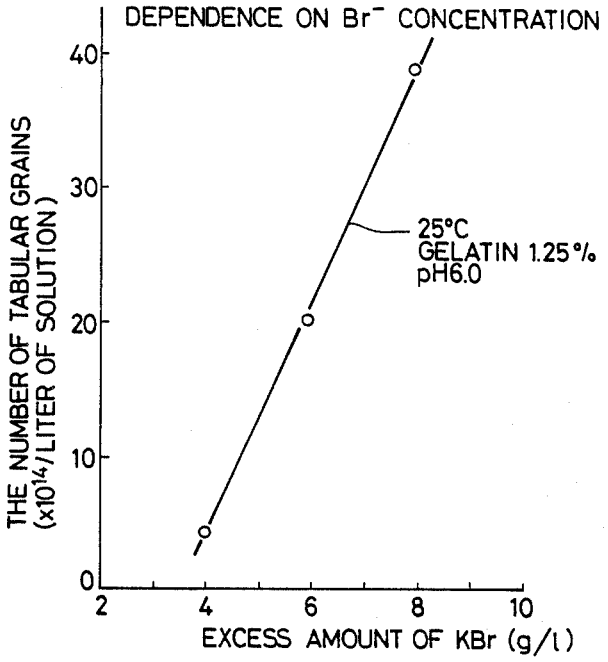
FIG. 18 is a graph showing the relation between the excess amount of KBr during nucleus formation and the number of tabular grains.
Figure 19:
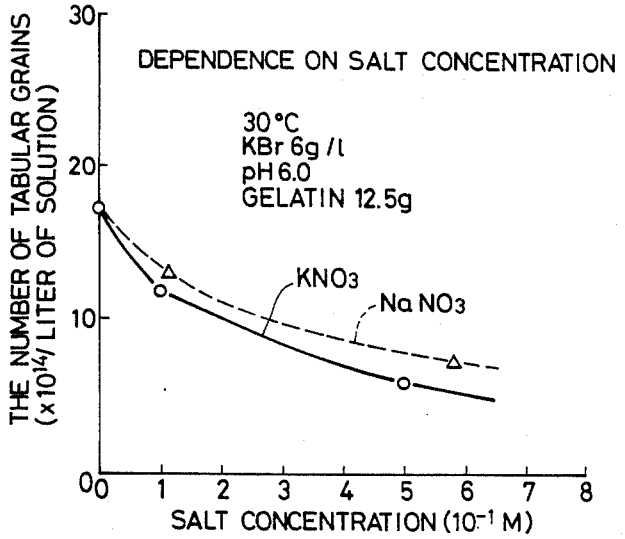
FIG. 19 is a graph showing the relation between the concentration of unrelated salts ($NaNO_3$ and $KNO_3$) and the number of tabular grains.
Figure 20:
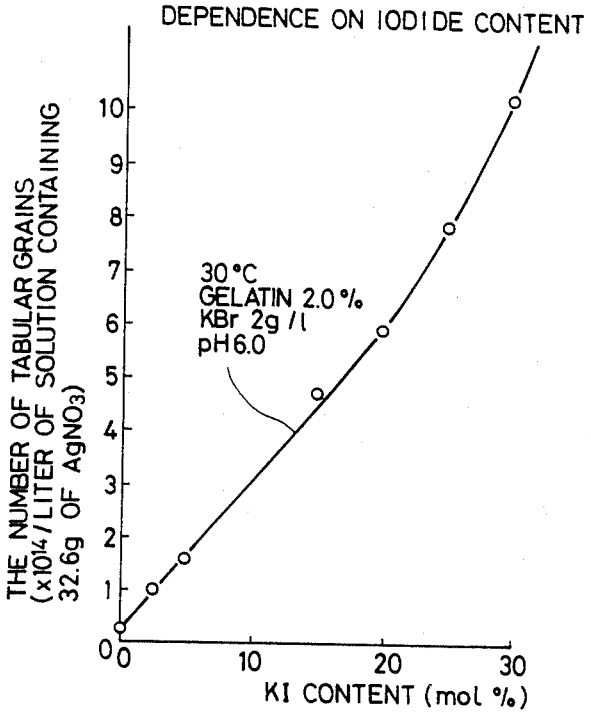
FIG. 20 is a graph showing the relation between the iodide content in the halogen ball and the number of tabular grains.
Figure 21:
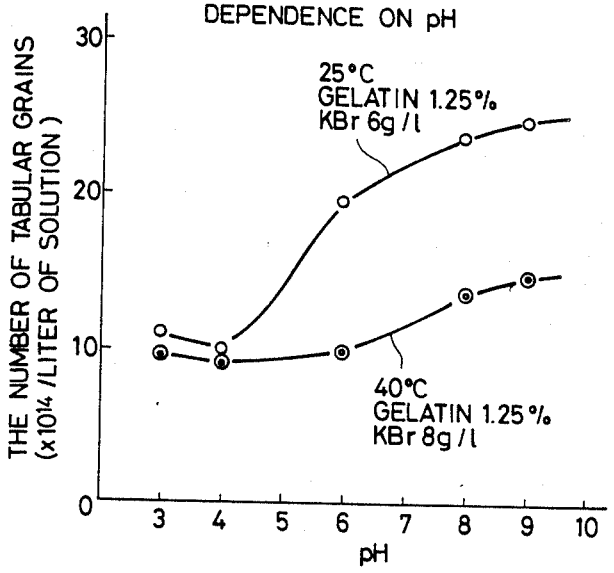
FIG. 21 is a graph showing the relation between the pH value and the number of tabular grains.

Then, unexposed Emulsion B was inhibition-developed using the Metol-ascorbic acid inhibition developer shown below and the center of development (i.e., center of fog) was determined by electron microscope. The results obtained are shown in FIG. 11, wherein the axis of abscissa shows the average projected area of the grains of each size class and the axis of ordinate shows the fogging rate of grains of each size class (i.e., the ratio of the number of grains having center of fog to the whole grain number). The results show that the chemical sensitization is insufficient for grains of small size but the chemical sensitization is performed excessively for grains of large size.

| MAA-1 Developer: | |
|---|---|
| Metol | 2.5 g |
| L-Ascorbic Acid | 10.0 g |
| Nabox (commercial name of Fuji Photo Film Co., Ltd.) | 35 g |
| Potassium Bromide | 1.0 g |
| Water | 1 liter |
| **Metol-Ascorbic Acid Inhibition Developer:** | |
| Metol | 0.02 g |
| L-Ascorbic Acid | 0.1 g |
| Borax | 5.0 g |
| Potassium Bromide | 1.0 g |
| Water | 1 liter |
| (pH adjusted to 9.6 with sodium hydroxide) | |

EXAMPLE 13

Emulsion A:

To 1 liter of a 3.0% by weight gelatin solution containing potassium bromide in a concentration of 0.07 M were added a 0.7 M solution of silver nitrate and a 0.7 M solution of potassium bromide in an amount of 15 ml each with stirring by a double jet method over a period of 15 seconds. Thereafter, the temperature thereof was raised to 75° C. and 400 ml of a 10% by weight gelatin solution was added to the mixture.

After finishing the aforesaid first addition step, 80 ml of a 0.6 M solution of silver nitrate was added thereto over a period of 30 minutes.

Thereafter, a 1.47 M solution of silver nitrate and a 1.47 M solution of potassium bromide were added to the mixture in an amount of 600 ml each by a double jet method at an accelerated flow rate (the flow rate at the end of the addition being 19 times the flow rate at the initiation thereof). During the addition, the pBr thereof was kept at 2.6. The silver halide emulsion thus formed was washed with an ordinary flocculation method and then dispersion gelatin was added thereto to provide 1,200 g of a core emulsion. The projected area proportion of the hexagonal tabular grains was 90% of the projected area of the whole silver halide grains thus obtained and the coefficient of variation was 15%. Also, the diameter of circle corresponding to the average projected area of the tabular grains was 1.3 μm and the average thickness thereof was 0.14 μm.

Then, to 200 g of the core emulsion formed above were added 800 ml of water and 30 g of gelatin and after dissolving gelatin, the temperature of the mixture was raised to 75° C. Then, 30 ml of 3,4-dimethyl-1,3-thiazolin-2-thione was further added to the mixture and by adding thereto 3 mg of sodium thiosulfate and 1 mg of potassium chloroaurate and heating the mixture to 70° C., a chemical sensitization was performed. To the core emulsion thus chemically sensitized were added a 1.47M solution of silver nitrate and a 1.47M solution of potassium bromide in an amount of 520 ml each by a double jet method at an accelerated flow rate (the flow rate at the end of the addition being 19 times the flow rate at the initiation thereof) as in the formation of core. The silver halide emulsion thus obtained was washed with an ordinary flocculation method and mixed with 50 g of dispersion gelatin to provide 1,200 g of a core/-shell silver halide emulsion.

The diameter of circle corresponding to the average projected area of the tabular grains was 2.6 μm and the average thickness thereof was 0.23 μm. Also, the projected area proportion of the hexagonal tabular grains was 83% of the projected area of the whole silver halide grains thus obtained and the coefficient of variation was 16%.

Then, by adding to the core/shell type emulsion 0.2 mg of sodium thiosulfate and 10 mg of poly(N-vinylpyrrolidone) followed by heating to 60° C. for 50 minutes, the surface of the grains was chemically sensitized. (Emulsion A)

Emulsion B (Comparison Emulsion):

An aqueous solution of potassium bromide and an aqueous solution of silver nitrate were added to a 3% by weight gelatin aqueous solution by a double jet method with stirring vigorously at 75° C. over a period of 60 minutes to provide a monodisperse octahedral silver bromide emulsion. Then, 100 mg of 3,4-dimethyl-1,3-thiazolin-2-thione per mol of silver before precipitation and 15 g of benzimidazoe per mol of silver were added to the emulsion. After finishing the precipitation, crystals having an average grain size of about 0.9 μm was formed. To the silver bromide grains were added 5.4 mg of sodium thiosulfate per mol of silver and 3.9 mg of potassium chloroaurate per mol of silver were added and the mixture was heated to 75° C for 80 minutes to perform chemical sensitization. To the core emulsion thus chemically sensitized were simultaneously added an aqueous solution of potassium bromide and an aqueous solution of silver nitrate over a period of 40 minutes as in the first procedure described above to provide a core/shell silver halide emulsion. The final average grain size was 1.3 μm. (Core/shell type direct positive octahedral silver bromide emulsion).

Then, to the core/shell type emulsion were added 0.32 mg of sodium thiosulfate per mol of silver and 57 mg of poly(N-vinylpyrrolidone) per mol of silver and the mixture was heated to 60° C. for 60 minutes to perform a chemical sensitization for the surface of the grains. (Emulsion B)

Preparation of Light-Sensitive Sheet:

A light-sensitive sheet (A) was prepared by forming layers (1) to (6) described below on a transparent polyethylene terephthalate support.

Layer (1): Mordant Layer

Layer (2): White Reflecting Layer

Layer (3): Light-Shielding Layer

Layer (4): Cyan DRR Compound-Containing Layer

Layer (5): Red-Sensitive Core/Shell Direct Positive Emulsion Layer

Layer (6): Gelatin-Containing Protective Layer

The details of the aforesaid layers were as follows.

Layer (1):

Mordant layer containing 3.0 g/m$^2$ of the copolymer having the recurring unit shown by the following formula described in U.S. Pat. No. 3,898,088 and 3.0 mg/m$^2$ of gelatin.

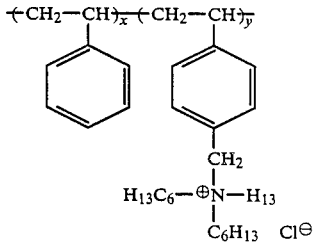

x/y = 50/50

Layer (2):

White reflecting layer containing 20 g/m$^2$ of titanium oxide and 2.0 g/m$^2$ of gelatin.

Layer (3):

A light-shielding layer containing 2.0 g/m$^2$ of carbon black and 1.5 g/m$^2$ of gelatin.

Layer (4):

A layer containing 0.44 g/m$^2$ of the cyan DRR compound shown below, 0.09 g/m$^2$ of tricyclohexyl phosphate, and 0.8 g/m$^2$ of gelatin.

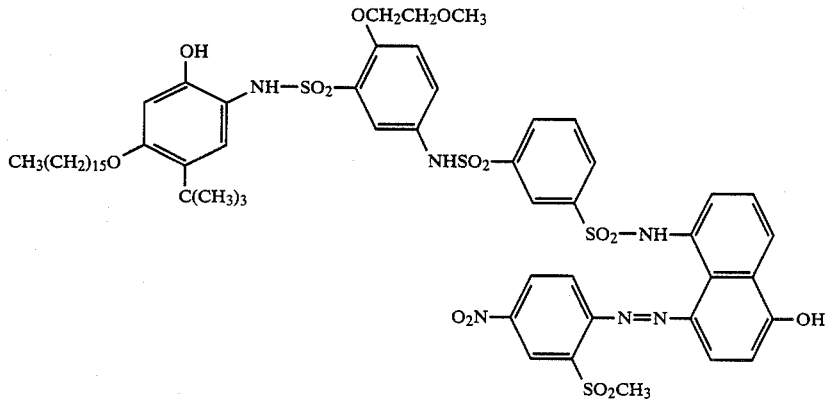

Layer (5):

A red-sensitive core/shell type direct positive silver bromide emulsion layer containing Emulsion (A) or (B) prepared as above (0.81 g/m$^2$ as silver), 0.01 mg/m$^2$ of 1-formyl-2-{4-[3-(3-phenylthioureido)benzamido]-phenyl}hydrazine, 4.3 mg/m$^2$ of 4-hydroxy-6-methyl-1,3,3a,7-tetraazaindene, and 0.11 g/m$^2$ of sodium 5-pentadecylhydroquinone-2-sulfonate described in Japanese patent application (OPI) No. 74729/79 as red sensitizing dyes and nucleating agent.

Layer (6):

A protective layer containing 1.0 g/m$^2$ of Each of the light-sensitive sheets thus prepared was combined with the cover sheet and the processing liquid described below, developed after light exposure, and the photographic properties (Dmax and Dmin) were measured.

| Processing Liquid: | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium Sulfite | 2.0 g |
| Carboxymethyl Cellulose Na Salt | 58 g |
| Potassium Hydroxide | 56 g |
| Benzyl Alcohol | 1.5 g |
| Carbon Black Dispersion (25%) | 600 g |
| Water to make | 1 kg |

The processing liquid having the above composition was filled in pressure rupturable container in an amount of 0.8 g.

Cover Sheet:

A cover sheet was prepared by coating the following layers (1') to (3') on a transparent polyethylene terephthalate support.

Layer (1'):

A neutralizing layer containing 22 g/m$^2$ of a copolymer of acrylic acid and butyl acrylate at 80:20 by weight ratio and 0.44 g/m$^2$ of 1,4-bis(2,3-epoxy- propoxy)butane.

Layer (2'):

A layer containing 3.8 g/m$^2$ of acetyl cellulose (forming 39.4 g of acetyl group by the hydrolysis of 100 g of the acetyl cellulose), 0.2 g/m$^2$ of a copolymer (molecular weight of about 50,000) of styrene and maleic anhydride at 60/40 by weight, and 0.115 g/m$^2$ of 5-($\beta$-cyanoethylthio)-1-phenyltetrazole.

Layer (3'):

A layer containing 2.5 g/m$^2$ of a latex of a copolymer of vinylidene chloride, methyl acrylate, and acrylic acid at 85/12/3 by weight ratio and 0.05 g/m$^2$ of a polymethyl methacrylate latex (particle size of 1 to 3 $\mu$m).

Exposure and Development:

The cover sheet was superposed on each of the above-described light-sensitive sheets and the lightsensitive sheet was imagewise exposed from the cover sheet side through a continuous tone wedge to xenon flash for $10^{-2}$ second. Thereafter, the aforesaid processing liquid was spread between both the sheets at a thickness of about 75 $\mu$m by the aid of compression rollers. The processing was performed at 25° C. 1 Hour after the processing, the cyan color density of the transferred image formed in the mordant layer (image-receiving layer) was measured through the transparent support of the light-sensitive sheet by means of a Macbeth reflection densitometer. The results obtained are shown in Table 1 below.

TABLE 1

| Emulsion | Dye*1 | Dmax | Relative Reversal Sensitivity (D = 0.5) | Relative Rereversal Sensitivity (D = 0.5) |
|---|---|---|---|---|
| A | None | 2.0 | 140 | *2 |
| A | Used | 2.5 | 200 | *2 |
| B | None | 1.9 | 100 | *2 |
| B | Used | 2.4 | 130 | 0.2 |

*1 Red-sensitive sensitizing dye

*2 The rereversal was not observed in the exposure range employed.

As shown above, it is clear that the lightsensitive sheet composed of the silver halide emulsion of the present invention shows a high reversal sensitivity and a low rereversal sensitivity.

In addition, the tabular core/shell grains of emulsion of the present invention dispose in parallel direction in the coated layer and have thinner thickness than octahedral grains and hence the thickness of the emulsion layer using the core/shell silver halide emulsion of the present invention can be reduced. Furthermore, the tabular core/shell grain emulsion of the present invention has a large surface area and shows fast development progress. Thus, by using the tabular core/shell grain emulsion of the present invention, images can be formed at high speed as a matter of course.

EXAMPLE 14

In a 4 liter reaction vessel was placed an aqueous gelatin solution (composed of 1,000 ml of water, 7 g of deionized alkali-processed gelatin, and 4 g of potassium bromide; having pBr of 1.47; pH adjusted to 6.0 with 1.2 ml of a 1 N potassium hydroxide solution). While keeping the temperature of the solution at 25° C., 60 ml of an aqueous silver nitrate solution (containing 32.6 g of silver nitrate) and 160 ml of an aqueous potassium bromide solution (containing 24.08 g of potassium bromide) were simultaneously added to the solution at a flow rate of 40 ml/min. over a period of 4 minutes and after stirring the mixture for 2 minutes, a flockulation agent and a 1 N nitric acid solution were added to the mixture to flockulate an emulsion at pH 4.0, which was washed with water. The amount of the emulsion formed was 400 ml and to 200 ml of the emulsion as a seed crystal emulsion was added an aqueous gelatin solution (composed of 1,150 ml of water, 2 g of potassium bromide, and 25 g of deionized alkali-processed gelatin) and after adjusting the pH thereof to 6.4, the temperature thereof was raised to 60° C. In this case, the silver potential in the nucleating period before raising the temperature to 60° C. was −45 mV. Also, the pBr at the nucleating period was about 1.47.

Then, after ripening the emulsion for 18 minutes at 60° C. (silver potential −20 mV), 250 ml of an aqueous silver nitrate solution (containing 26 g of silver nitrate) and 250 ml of an aqueous potassium bromide solution (containing 18.94 g of potassium bromide) were simultaneously added to the emulsion over a period of 25 minutes. During the addition, the silver potential was stable at −20 mV.

After the addition, the mixture was stirred for 5 minutes, then the temperature thereof was raised to 75° C., and after ripening for 30 minutes, the temperature was reduced to 30° C. The silver halide emulsion thus obtained was washed with water and dispersed. In addition, the addition of solutions in this example was performed by a direct addition-into-solution system, i.e., in the solution addition systems in the example, an addition system by injection drived by pulse motor is employed in each case.

By viewing the replica images of the emulsion grains obtained using a transmission type electron microscope (magnification of 2,000 ×), the average grain sizes and the average thicknesses were measured on 600 all the tabular grains having diameter of at least 0.15 μm and the aspect ratio (average grain size/ average thickness) was measured.

Also, the projected area proportion of the tabular grains having diameter of at least 0.15 μm to the projected area of the whole silver halide grains thus obtained was determined. Furthermore, the coefficient of variation of the diameters of the tabular grains having a diameter of at least 0.15 μm was determined.

Average Grain Size: 0.32 μm
Average Thickness: 0.076 μm
Average Aspect Ratio: 4.2
Projected Area Proportion of Tabular Grains: 88%
Coefficient of Variation of Projected Grain Sizes: 19%

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising a dispersion medium and silver halide grains, wherein the projected area of hexagonal tabular silver halide grains having as the basal planes having an adjacent edge ratio of 2/1 to 1/1 accounts for from 70% to 100% of the projected area of the whole silver halide grains, and further said hexagonal tabular silver halide grains are monodisperse grains wherein the average aspect ratio of the hexagonal tabular silver halide grains is from 2.5/1 to 20/1.

2. A silver halide emulsion as in claim 1, wherein the adjacent edge ratio is from 1.0/1 to 1.5/1.

3. A silver halide emulsion as in claim 1, wherein the projected area of hexagonal tabular silver halide grains having two basal planes having the adjacent edge ratio of 2/1 to 1/1 accounts for at least 90% of the projected areas of the whole silver halide grains.

4. A silver halide emulsion as in claim 1, wherein the coefficient of variation of the sizes of the hexagonal tabular silver halide grains is 1 to 20%.

5. A silver halide emulsion as in claim 1, wherein the coefficient of variation of the sizes of the hexagonal tabular silver halide grains is at most 15%.

6. A silver halide emulsion as in claim 1, wherein the hexagonal tabular silver halide grains have a core/shell structure.

7. A silver halide emulsion as in claim 6, wherein the halogen composition differs between the core and the shell in the core/shell structure.

8. A silver halide emulsion as in claim 1, wherein the silver halide grain is of an internal latent image type.

* * * * *